US011247224B2

(12) United States Patent
Günaydin

(10) Patent No.: US 11,247,224 B2
(45) Date of Patent: Feb. 15, 2022

(54) DEVICE FOR APPLYING A LIQUID

(71) Applicant: Turhan Günaydin, Bielefeld (DE)

(72) Inventor: Turhan Günaydin, Bielefeld (DE)

( * ) Notice: Subject to any disclaimer, the term of this patent is extended or adjusted under 35 U.S.C. 154(b) by 0 days.

(21) Appl. No.: 16/789,933

(22) Filed: Feb. 13, 2020

(65) Prior Publication Data

US 2020/0254479 A1 Aug. 13, 2020

(30) Foreign Application Priority Data

Feb. 13, 2019 (DE) ..... 10 2019 103 587.2

(51) Int. Cl.
*B05C 17/10* (2006.01)

(52) U.S. Cl.
CPC ..... *B05C 17/10* (2013.01)

(58) Field of Classification Search
USPC ..... 401/261–267; 118/264, 300, 304
See application file for complete search history.

(56) References Cited

U.S. PATENT DOCUMENTS 2,800,673 A * 7/1957 Lazisky ..... A45D 33/28 401/188 R
2,995,768 A * 8/1961 Skuratowicz ..... A45D 34/04 401/146
3,603,692 A 9/1971 Bali et al.
4,955,747 A 9/1990 Tarver
2013/0294809 A1 11/2013 Eggers
2014/0317866 A1* 10/2014 Burt ..... A47K 7/02 15/210.1
2016/0129471 A1 5/2016 Zhou et al.

FOREIGN PATENT DOCUMENTS

DE 202010011483 U1 8/2011
DE 202010012186 U1 12/2011
EP 1 293 440 B1 2/2008
ES 1030657 U 9/1995

* cited by examiner

*Primary Examiner* — Yewebdar T Tadesse

(74) *Attorney, Agent, or Firm* — 24IP Law Group USA, PLLC; Timothy DeWitt

(57) ABSTRACT

A device for applying a liquid of different viscosity to a surface to be wetted is presented, having a reservoir for the liquid arranged in a housing, a valve unit for the metered discharge of the liquid from an outlet opening of the reservoir and an application unit connected to the valve unit on its outer side facing away from the housing, wherein, according to the invention, a removal device for removing excess liquid from the surface wetted by the application unit is arranged on the side of the housing opposite the valve unit.

13 Claims, 10 Drawing Sheets

DEVICE FOR APPLYING A LIQUID

CROSS-REFERENCE TO RELATED APPLICATIONS

The present application claims priority to German Patent Application Serial No. DE 10 2019 103 587.2 filed by the present inventor on Feb. 13, 2019.

The aforementioned German patent application is hereby incorporated by reference in its entirety.

BACKGROUND OF THE INVENTION

Field of the Invention

The invention relates to a device for applying a liquid of different viscosity to a surface to be wetted, having a reservoir for the liquid arranged in a housing, a valve unit for the metered discharge of the liquid from an outlet opening of the reservoir and an application unit connected to the valve unit on its outer side facing away from the liquid container.

Brief Description of the Related Art

The device described at the beginning is known from the state of the art in various forms.

For example, devices are offered with which shoe polish can be distributed on surfaces. Other applications are known from the cosmetic field, where liquids or creams can be applied to skin areas by means of the appropriate devices. Such devices are usually equipped with a valve unit which can be opened or closed by means of a cover cap which can be attached to the application unit from outside.

For example, a product storage and dispensing device is known from EP 1 293 440 B1, in particular for cosmetic products, in which a container containing the product has an opening which is equipped with a valve unit and in which a structure is mounted on the container, the removable structure being designed in such a way that an operation of the valve unit is brought about by means of an attached cover cap, wherein the cover cap also serves to cover an application unit arranged on the outside of the device for distributing the liquid located inside the reservoir.

The above-mentioned publication offers different embodiments with regard to the valve unit and the application unit to ensure that the valve unit is operated to close and release the outlet opening of the reservoir.

As already described above, the field of application of such a device known from the state of the art is manifold. In general, it ranges from the cleaning of sensitive surfaces such as displays of smartphones, tablets, laptops, scanners, cash register scanners, TV-devices to cleaning of glasses, optical lenses, glass panes, and medical technology, where fields of application for the application and incorporation of medical tinctures and healing ointments on the skin are known. In addition, as mentioned above, fields of application from the cosmetics and household sector are obvious.

Common to all fields of application is that the liquids of different viscosity applied by means of the known devices have to be applied by the user in a well-metered manner to the surface to be wetted. The application requires a great deal of attention to ensure that no excessive amount of liquid is applied to the surface in an uncontrolled manner by the application unit.

Practical applications have shown that, despite appropriate attention by the user, there is often a need to remove a part of the applied liquid from the wetted surface again. For this purpose, a separate removal cloth, a cotton ball or other objects with a certain absorption capacity for the liquid used have hitherto been necessary.

The procurement of appropriate removal cloths is sometimes associated with a corresponding amount of effort, so that in a considerable number of cases in which a repeated removal of excess liquid is not possible due to a lack of removal cloths or similar, the intended cleaning effect cannot be optimally realized due to the application of liquid.

SUMMARY OF THE INVENTION

Starting from the various devices known from the state of the art for the application of a liquid of different viscosity to a surface to be wetted with the features mentioned in the generic part of claim 1, it is an object of the invention to further develop a device of the described type in such a way that, under given conditions, the removal of excess liquid from the surface to be wetted is possible at any time and thus an optimum application and cleaning effect can be achieved with the corresponding devices. Furthermore, the device according to the invention should be inexpensive to manufacture and flexible with regards to its application and the liquids used.

The described object is solved by the technical teachings presented in the independent claims. Preferred embodiments are defined in the dependent claims.

It is essential for the invention of the independent claims that a removal device for removing excess liquid from the surface wetted by the application unit is arranged on the side of the reservoir opposite the valve unit.

The teachings according to the invention ensure, by means of the additional removal device firmly connected to the device for applying a liquid, that excess liquid can be removed again from the surface to be cleaned and wetted at any time without the need for separate removal cloths. This significantly simplifies the handling of corresponding devices, as unnecessary efforts to obtain separate cloths can be eliminated.

Special features of the subject-matter of the invention may result additionally from the features of the dependent claims.

In particular, it has been shown to be advantageous if the removal device has a working surface provided with a microfiber cloth, the working surface being located on the outside of a device housing which is connected to the reservoir. The microfiber cloth used combines a removal of excess liquid with a polishing option through the liquid used, so that especially sensitive surfaces, such as mobile phone or tablet displays, can be cleaned easily and reliably without streaks.

In addition, it has proven to be advantageous if a coupling unit for separating and connecting the components is arranged between the device housing and the housing of the reservoir. Thus, the removal device can be replaced by the coupling unit located on the device housing, so that, for example, a soaked microfiber cloth can be replaced by a fresh and absorbent one.

In addition, it is possible to adapt the device according to the invention for liquids of different viscosity, since the removal device can be optimally adapted to the liquid in the reservoir.

With regard to the design of the coupling unit, it has proven to be useful to fix it detachably to the reservoir by means of one or more connecting clips.

In order to further increase the use time of the device according to the invention, it has been shown to be advantageous, in addition to the replaceability of the removal device, for the housing to have an interior space into which a separate can-shaped container filled with the liquid is replaceably inserted. The described constructional design is also advantageous with regard to sustainability, as the device does not have to be disposed of after emptying the reservoir, but the device can be made functional again by placing a separate container filled with liquid in the housing of the reservoir.

In addition, it is preferable to provide the removal device with a protective cap that can be covered, since, especially in the case where liquid has already been taken up by the removal device, an unintentional return of the liquid taken up is reliably ruled out by putting on the cover cap.

It may also be advantageous if the removal device under the microfiber cloth has a sponge-like element to store the liquid absorbed by the microfiber cloth. The described measure can additionally extend the use time before the necessary replacement of the removal device, since a larger quantity of liquid can be removed from the wetted surface.

In a further preferred aspect, the application unit and/or the removal device are each mounted on the housing via an adapter. For this purpose, the application unit and/or the removal device can be connected to the respective adapter(s) by one of a bayonet lock, a thread, a detachable rivet connection, a clip connection, and/or a threadless section which can be slipped on, plugged on or clamped on.

In a further preferred aspect, the adapter can be connected to the housing by means of a form closure, a clip and a thread and/or slipped on, plugged on or clamped on over an upper area.

In another preferred aspect, the bayonet lock is designed in such a way that a plurality of recesses allows a plurality of cylindrical projections of the application unit and/or the removal device a relative movement in axial direction between the application unit and/or the removal device to the respective adapter.

In a further preferred aspect, a microfiber cloth can be connected to the application unit and/or the removal device by one of a hook and loop fastener, an adhesion configuration, an adhesive, an overwrapping of an elastic edge of the microfiber cloth and barbs on a ring groove. A hook and loop fastener, an adhesion configuration and/or an adhesive could be positioned between the microfiber cloth and the application unit and/or the removal device. Adhesive could be applied to either or both of the microfiber cloth and the mating application unit and/or removal device. A possible adhesion configuration could be provided by positive interlocking of microscopically small pores and depressions between the materials involved.

BRIEF DESCRIPTION OF THE DRAWINGS

Below, two examples of the subject matter of the invention are explained in more detail using the attached drawings. It shows.

DETAILED DESCRIPTION OF THE INVENTION

Figure 1:
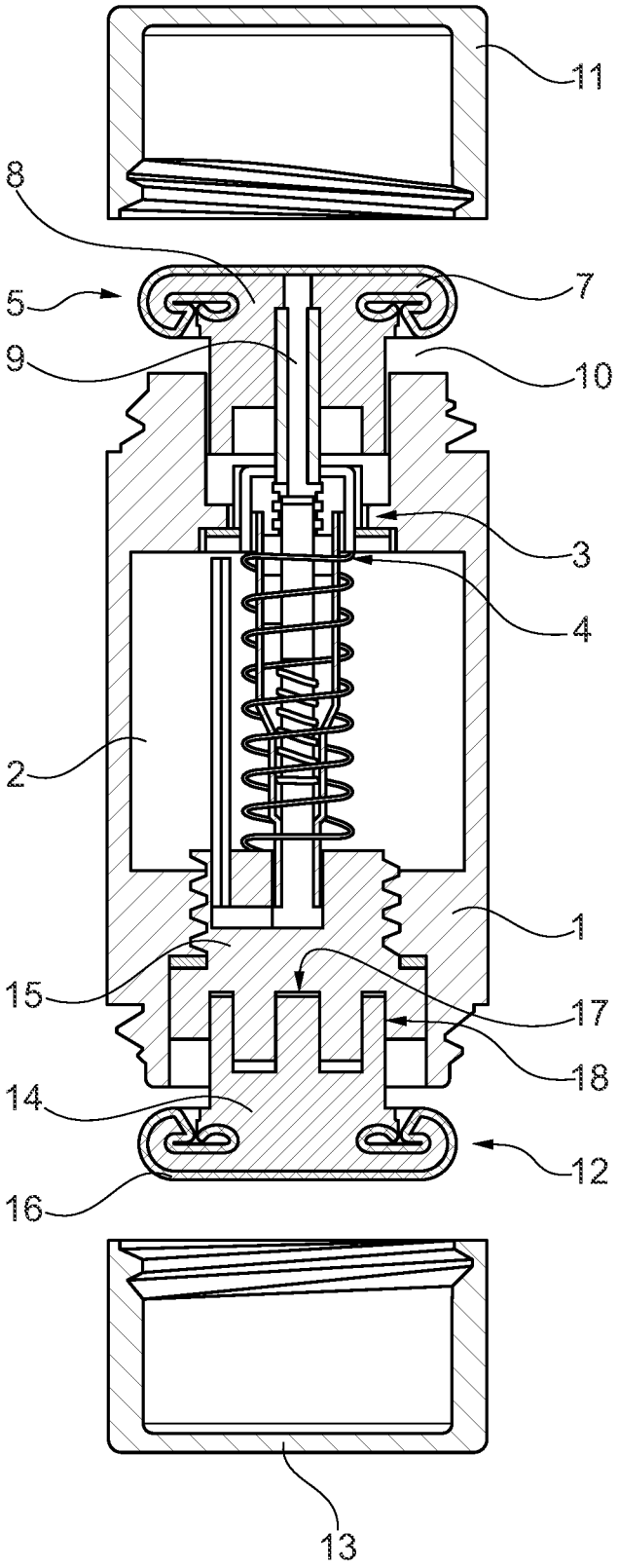
FIG. 1 a sectional view of a first variant of the device according to the invention for applying a liquid, FIG. 2 a partially transparent view of a second variant of the device according to the invention, FIG. 3 an exploded view of the components of the device according to the invention in FIG. 2, FIG. 4 a sectional view of the second variant of the device for applying a liquid according to the invention, and FIG. 5 an enlarged view of detail D from FIG. 4, FIG. 6 a third variant of the previously described variants of the device according to the invention for applying a liquid, FIGS. 7A to 7C a first adapter, FIGS. 8A and 8B a second adapter, FIGS. 9A and 9B a second variant of an application unit, FIGS. 10A and 10B a third variant of the application unit, FIGS. 11A and 11B a fourth variant of the application unit, FIGS. 12A and 12B a fifth variant of the application unit, FIG. 13 a different form of the application unit, FIG. 14 a fourth variant of the previously described variants of the device according to the invention for applying a liquid.

The device shown in FIG. 1 for applying a liquid of different viscosity to a surface to be wetted has a housing 1, preferably made of plastic, in which a central reservoir 2 for the liquid intended for wetting is recessed.

Reservoir 2 has an outlet opening 4 at its top as shown in FIG. 1. A valve unit 3 is attached to the outlet opening 4, part of the components of which protrude into the reservoir 2. The constructional design of valve unit 3 corresponds to the usual design variants known from the state of the art. Since it is not the subject of inventive teaching, no further explanation of the individual parts is given. The valve unit 3 is used to supply an application unit 5 on the top of valve unit 3 facing away from the reservoir 2 with liquid from reservoir 2 in a suitable manner.

The application unit 5 is equipped with an application element 7 on its upper side facing away from the valve unit 3. The application element 7 can be made of a suitable fluid or the like and is permeable for the liquid supplied from below through the valve unit 3. Below the application element 7, there is advantageously a connecting part 8 made of elastic material, which has a passage channel 9 for the liquid in its center and is equipped with an intermediate space 10.

Application element 7 and connecting part B form an assembly unit which, in the assembled state of the device according to the invention, is covered by a closure cap 11 when not in use. The closure cap 11 can be screwed onto the body 1 of the device by means of a thread, as shown in FIG. 1. Alternatively, other types of fastening are of course conceivable, such as a clip closure.

If, with the aid of the device according to the invention, liquid from the reservoir 2 is applied to a surface to be wetted via the application unit 5, pressure from above on the application element 7 reduces the intermediate space 10 and an impulse is applied to the valve unit, which causes it to transport liquid from the reservoir 2 via the outlet opening 4 and the passage channel 9 to the top of the application unit 5 by means of a pumping movement.

The liquid located on the application element 7 is transferred to the surface to be wetted (skin, display or similar) due to the translatory movement of the entire device.

In order to remove excess liquid from the wetted surface, the device is equipped with a removal device 12 on the lower side of the housing 1 opposite the application unit 5. The closure flap 13 can be connected to the housing 1 in the same way as the closure cap 11 by means of a screw device or by clipping.

The removal device 12 essentially consists of an elastic outer part 14 and a fixed inner part 15, which is screwed into housing 1. The outer part 14 and the inner part 15 can be designed replaceable in a suitable manner. On the outside of the outer part 14, this is covered by a suitable removal means, for example a microfiber cloth 16, which extends around the side surfaces of the outer part 14 and serves as a suitable working surface for absorbing excess liquid from the wetted surface. Alternatively, the material can be leather or another suitable material.

The inner part 15 has a central recess 17 as shown in FIG. 1 as well as an annular circumferential recess 18, in which the foot area of the outer part 14 engages and is held. The recesses 17 and 18 serve as so-called coupling element for the detachable fixing of the outer part 14 to the inner part 15 and to the housing 1. Through this constructional design, the outer part 14 can be replaced together with the removal means in the microfiber cloth 16, provided that it is soaked with liquid during the use of the device according to the invention.

In addition, the replaceability of the removal device 12 has the advantage that the elastic consistency and liquid absorption capacity of the outer part 14 can be adapted to the liquid consistency in reservoir 2.

As can be seen, the variant of the device according to the invention shown in FIG. 1 has a reservoir 2 which is provided with liquid for the user at the time of purchase. Since the components of the valve unit 3 and the application unit 5 are usually still operational after removal of all liquid, the device may be designed in such a way that reservoir 2 can be refilled with liquid according to an advantageous further development of the object of the invention.

Figure 2:
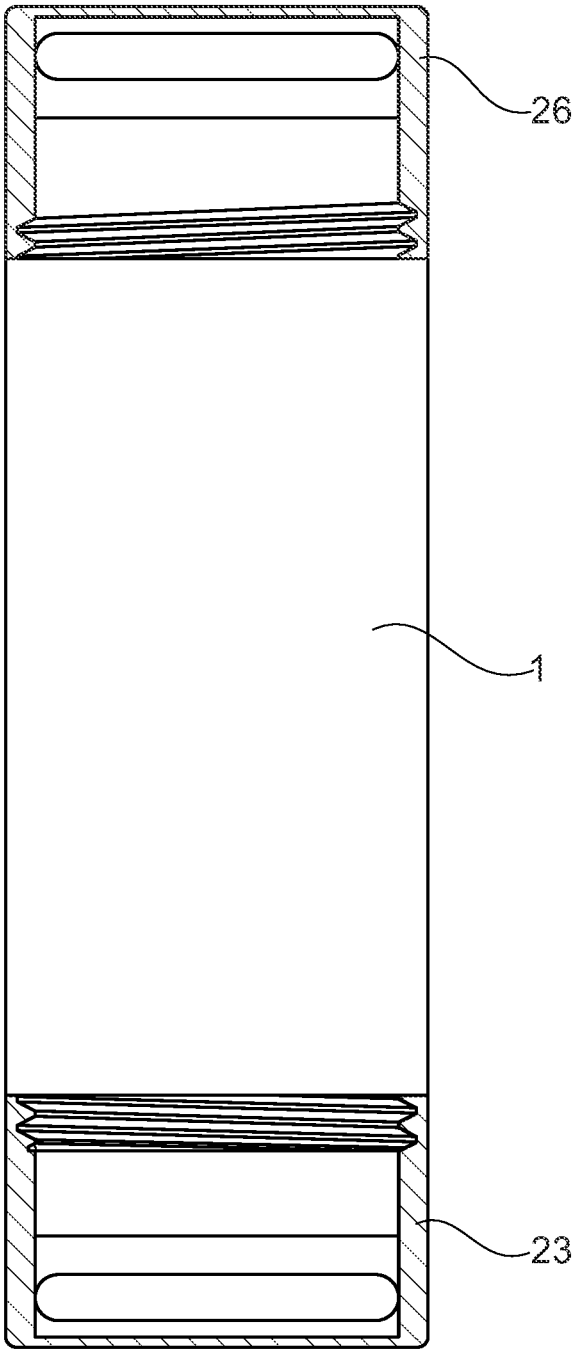
Figure 3:
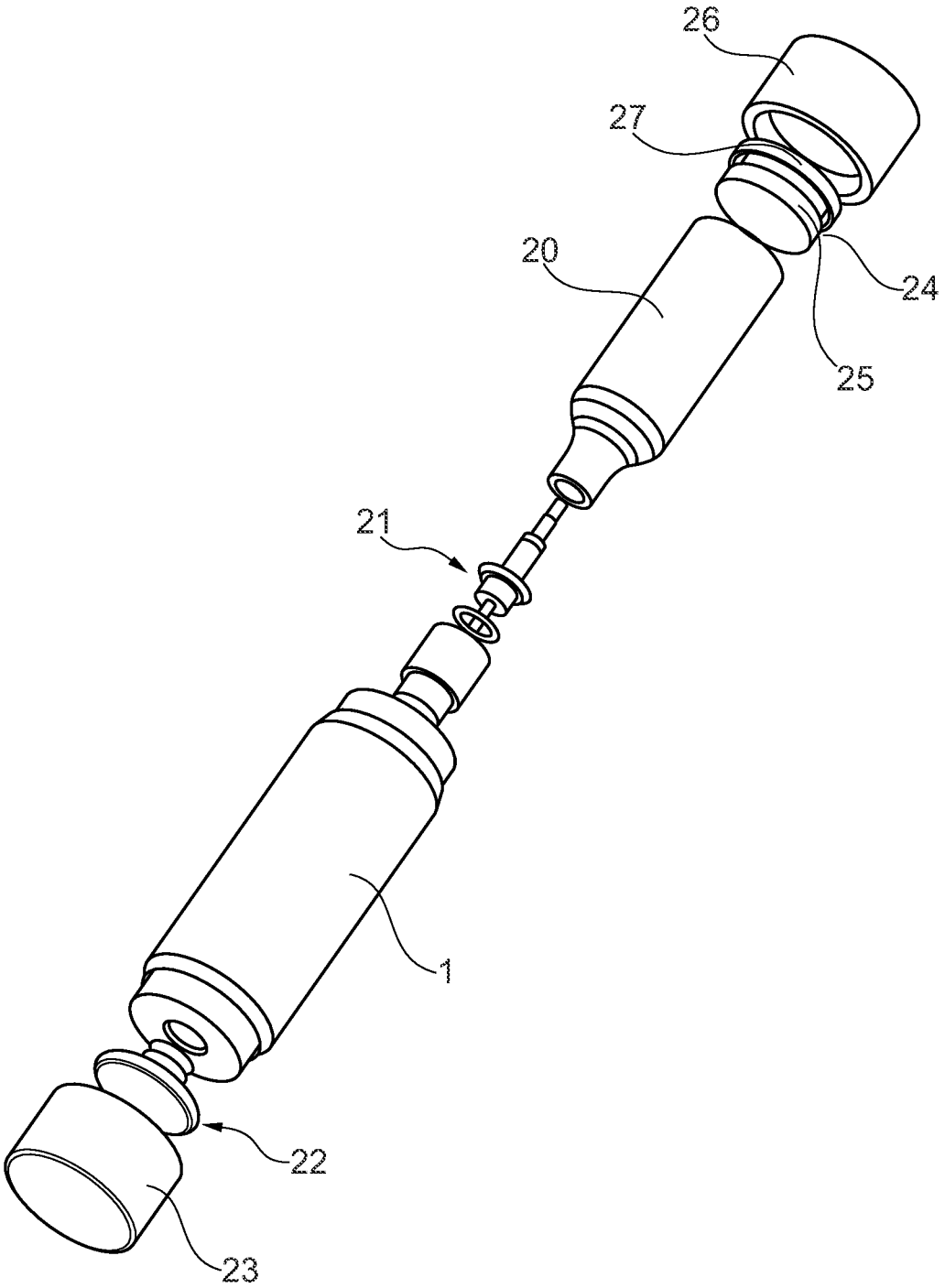
Figure 4:
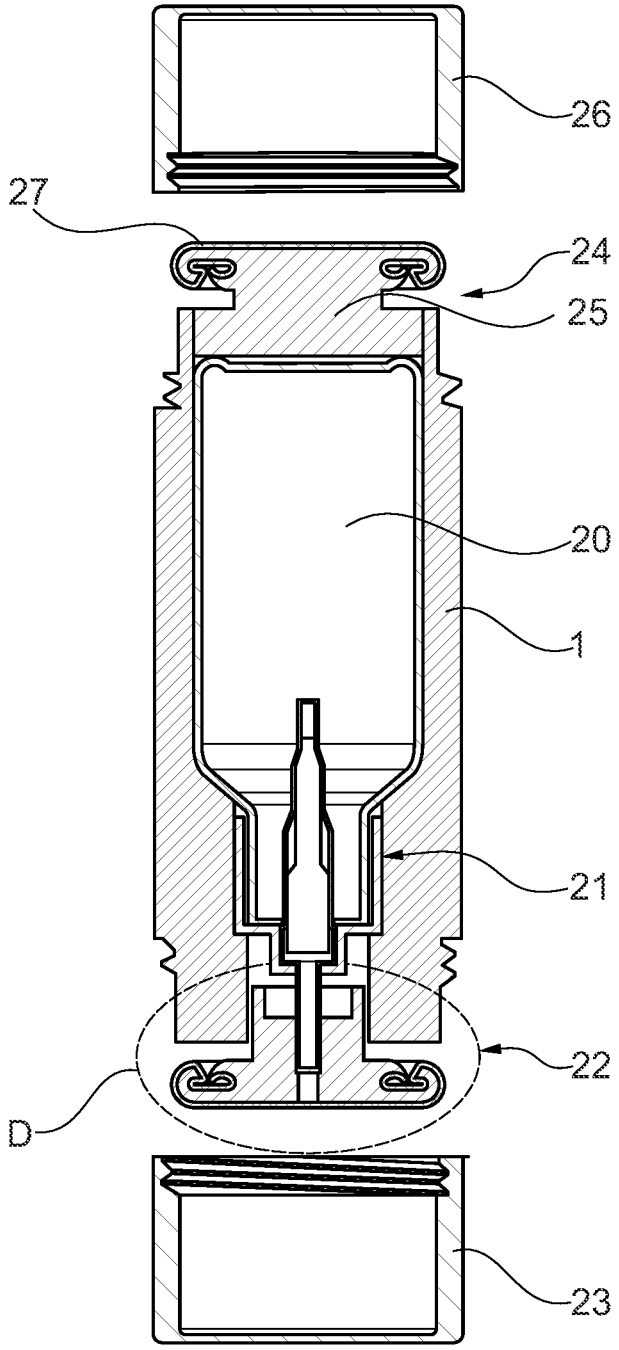
Figure 5:
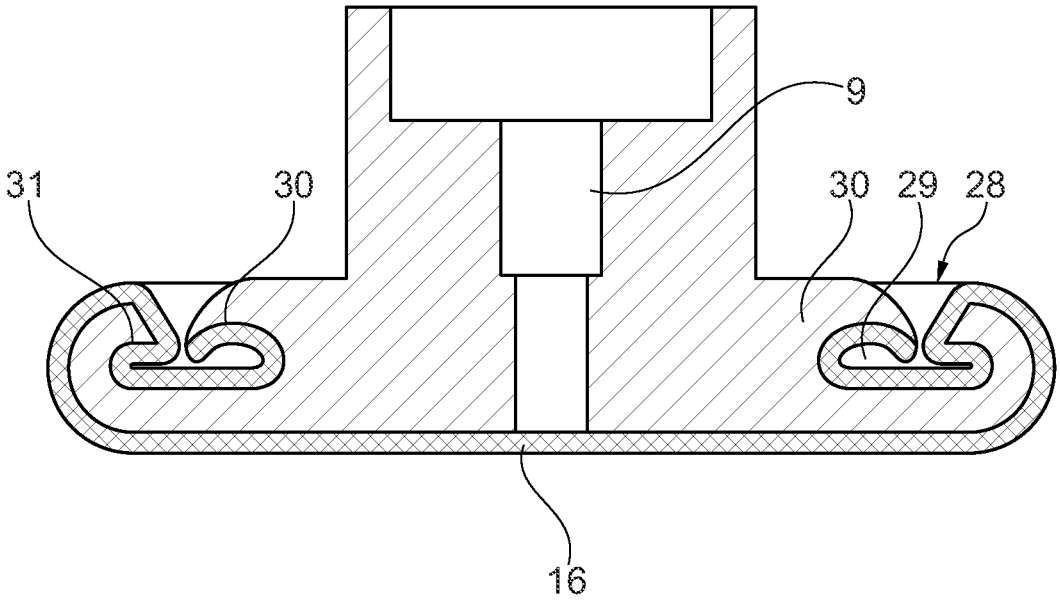

A possible variant of replenishment is illustrated in the design variant of FIGS. 2 to 4. In the embodiment shown, housing 1, as shown in the sectional view of FIG. 1, has an interior space into which a container 20 in the form of a spray can be inserted. Together with a valve unit 21, container 20 forms a common assembly and can be inserted into housing 1 from one side.

On the top of valve unit 21, facing away from housing 1, there is an application unit 22, analogous to the embodiment variant in FIG. 1, which can be covered by means of a cover flap 23 when the device is not in use.

According to the invention, a removal device 24 is arranged on the bottom of the can-shaped container 20 opposite the valve unit 21 analogous to the embodiment variant of FIG. 1. The removal device essentially comprises an elastic element 25, which is clamped into housing 1 below the container 20. The element 25, like the outer part 14, is covered by the removal means in the form of the microfiber cloth 27, which extends around the outer edge of the element 25. In analogy to the illustration in FIG. 1, the removal device 24 can also be covered with a cover cap 26 when not in use, whereby the cover cap 26 is screwed to the housing 1.

The individual parts of the second variant of the device for the application of a liquid according to the invention are again clarified in the exploded diagram in FIG. 3. The reference numbers shown there correspond to those in FIG. 4.

FIG. 2 shows the second embodiment variant of FIGS. 3 and 4 in closed condition with the two cover flaps 26 and 23. For clarification, the cover flaps 23 and 26 are formed as transparent components.

As mentioned above, both the application unit 5 or 22 and the removal device 12 or 24 are covered on their outside with the removal means of a microfiber cloth 16 or 27. The different reference numbers of the above-mentioned components refer to the respective designs as shown in FIG. 1 and FIG. 4.

The application and removal means in the form of the microfiber cloths 16, 27 are drawn around the edge of the element 25 or the outer part 14, as shown in the figures. The outer parts 14 and the element 25 each have an annular groove 29 accessible via the channel 28 from the rear side, i.e. the side facing the housing 1. The annular groove 29 is formed around the circumference. The annular groove 29 has a substantially oval shape, with the longitudinal extension parallel to the outer sides covered with the microfiber cloths 16, 27 being longer than the width perpendicular to it. Barbs 30 and 31 are located on the two edges of the entrance to channel 28 facing the annular groove.

When assembling the removal device 12 or 24 as well as the application unit 5 and 22, the covering take-off sleeve in the form of the microfiber fabric liner 16, 27 is inserted into the annular groove 29 by suitable assembly-side measures. The barbs 30 and 31 located at the exit of channel 28 facing the annular groove 29 keep the microfiber clothes 16, 27 in position.

The elements 14, 25 equipped with the removal means in the form of microfiber cloths 16, 27 are designed to be exchangeable in accordance with an advantageous further development, where the corresponding microfiber cloths 16, 27 themselves can also be designed to be exchangeable as described below by way of example.

Figure 6:
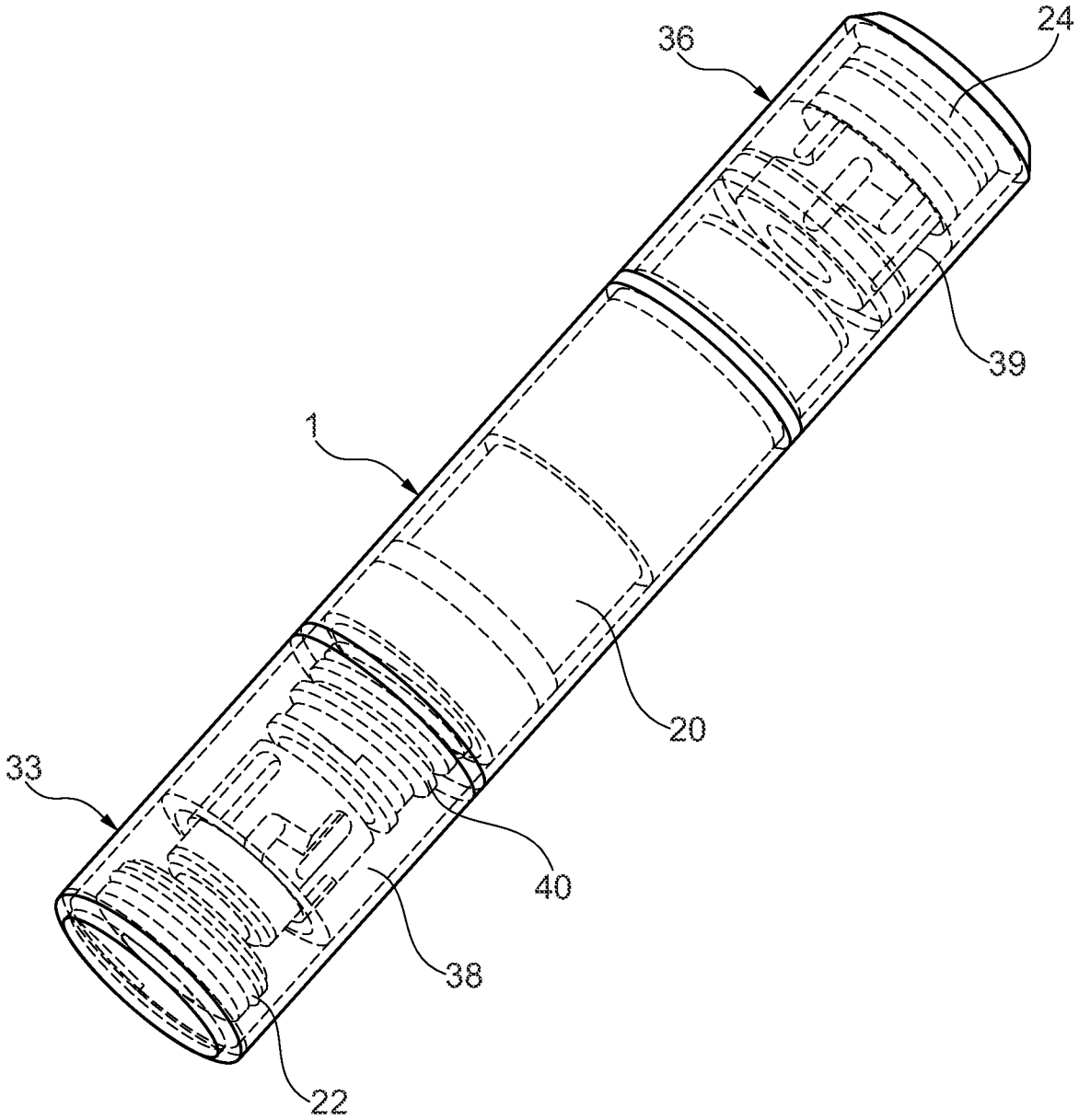

FIG. 6 shows a third variant of the previously described variants of the device in closed condition with a partially transparent housing 1 and two partially transparent cover caps 33 and 36. Under the cover cap 33, the application unit 22 is shown in a further configuration. Under the cover cap 36 the removal device 24 is shown in a further configuration. In the housing 1 the container 20 is shown. The container 20 is positioned between a first adapter 38 and a second adapter 39, which in this variant serve to hold the container 20 in the housing 1. As with the variants described above, container 20 can be a container equipped with a common pump mechanism, for example made of glass, plastic or metal, which can preferably be designed to be refillable. The cover caps and the housing can be made of a suitable material, such as aluminum or plastic, which can be manufactured particularly easily by injection molding.

Figure 7A:
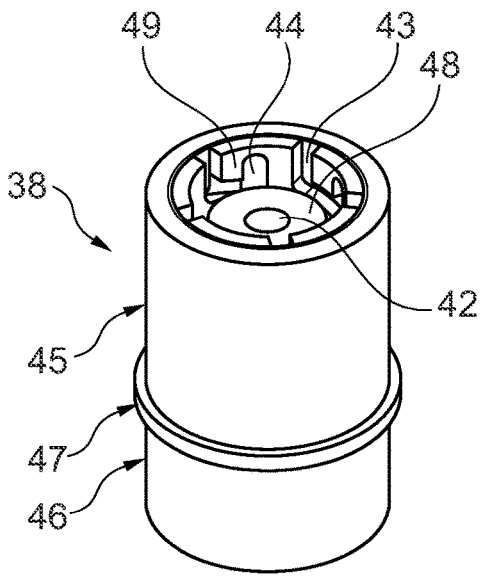
Figure 7B:
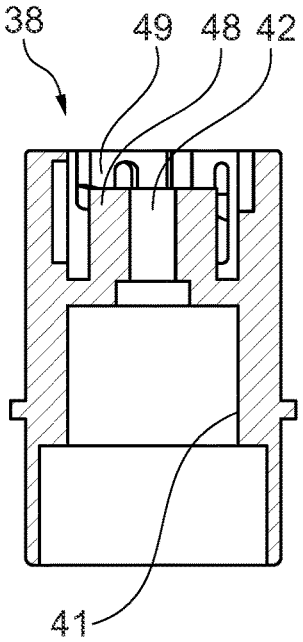
Figure 7C:
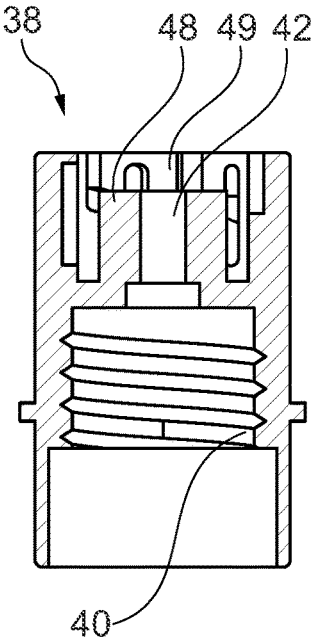

FIGS. 7A to 7C show the first adapter 38. FIG. 7C shows the first adapter 38 with a thread 40. The first adapter 38 can be designed with the thread 40 if the cylindrical container 20 is provided with a threaded section. If the container 20 has a threaded section, the container 20 can be screwed to the first adapter 38 in this configuration. The valve unit 21 is pushed with a part of its components through a passage channel 42 when screwing the container 20 into the first adapter 38 by using the thread 40.

As shown in FIG. 7B, the first adapter 38 can also be designed without a thread 40 (section 41), if the cylindrical container 20 is not provided with a threaded section. If the container 20 does not have a threaded section, the container 20 in this configuration can be positively fitted into the first adapter 38 via a section 41. The valve unit 21 is pushed with part of its components by inserting the container 20 into the first adapter 38 through a passage channel 42. The passage channel 42 is formed into a cylindrical section 48 of the first adapter 38, whereby the cylindrical section 48 is spaced from an inner side 49 of the first adapter 38.

FIG. 7A shows a first view of the first adapter 38. The first adapter 38 contains a plurality of recesses 43 on the inner side 49. The plurality of recesses 43 serves to form a bayonet lock 44. The cover cap 33 is fitted positively over an upper section 45 of the first adapter 38 when assembled. The upper section 45 of the first adapter 38 can be separated from a lower section 46 by a collar 47. The first adapter 38 can be inserted into the housing 1 of the device by the lower section 46. For the skilled person, further, non-restrictive connection possibilities such as clamping, slipping or plugging and connecting by means of a clip are known from the prior art.

Figure 8A:
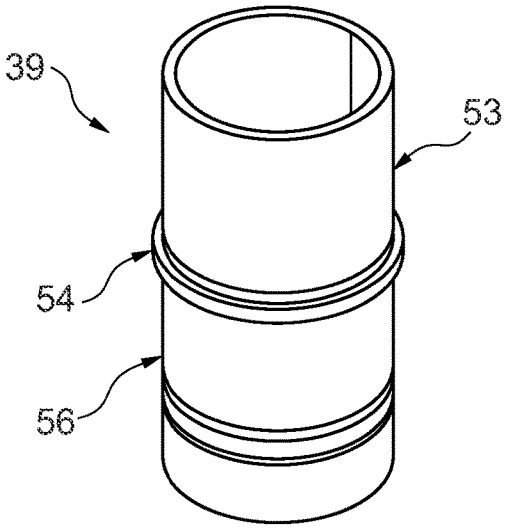
Figure 8B:
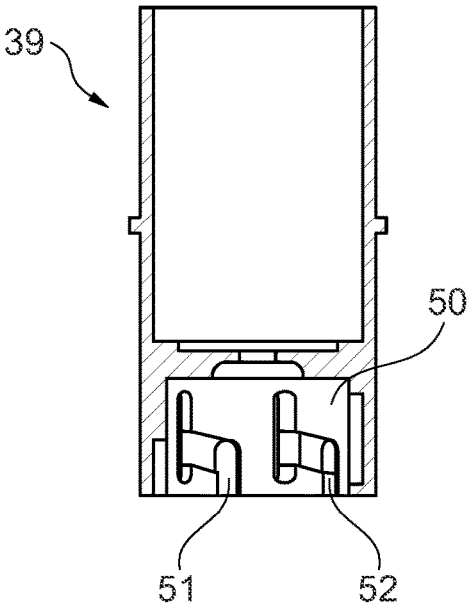

FIGS. 8A and 8B show the second adapter 39. As seen in FIG. 8B, the second adapter 39 may have a recess 51 on an inner side 50 to form a bayonet lock 52. It should be noted that the second adapter 39 is optional and the provision of the bayonet lock 52 is also optional because, as will be explained later, the interchangeability of the microfiber cloth intended for dry wiping can be achieved without replacing the element 25 or the outer part 14, for example, by other means than those described above, such as by a hook-and-loop fastener.

As can be seen in FIG. 8A, the cover cap 36 can be fitted positively in the assembled state over an upper section 53 of the second adapter 39. The upper section 53 of the second adapter 39 can be separated from a lower section 55 by a collar 54. The second adapter 39 can be inserted into the housing 1 of the device by the lower section 55. For the skilled person, further, non-restrictive connection possibilities such as clamping, slipping or plugging and connecting by means of a clip are at least suggested from the prior art.

Figure 9A:
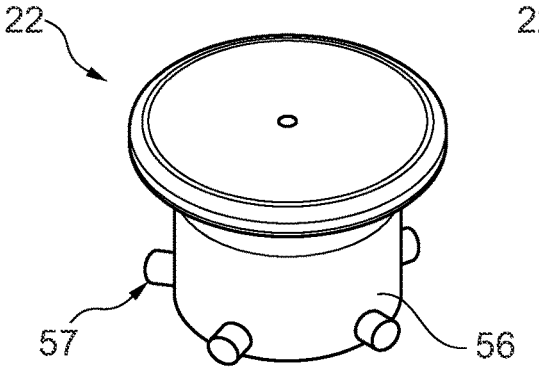
Figure 9B:
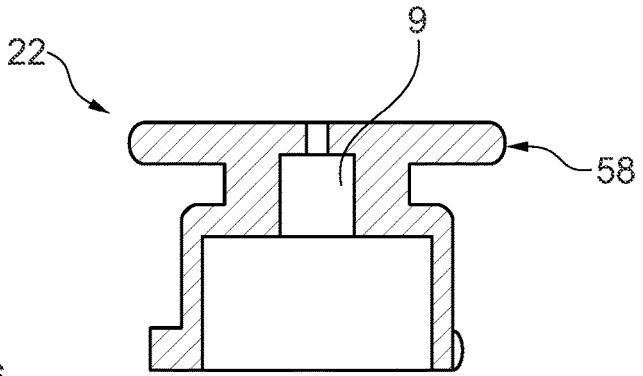

FIGS. 9A and 9B show a second type of the application unit 22 with a plurality of cylindrical projections 57 attached to a lower section 56 of the application unit 22, wherein the cylindrical projections 57 extend in a radial direction away from the lower section 56 of the application unit 22. The plurality of cylindrical projections 57 is designed in such a way that the plurality of cylindrical projections 57 can be inserted into the plurality of recesses 43 on the first adapter 38 and thus form the counterpart of the bayonet lock 44. The design of the bayonet lock 44 on the first adapter 38 allows this variant of the application unit 22 to be moved in axial direction relative to the first adapter 38, in order to enable a pumping movement. In this second variant of the application unit 22, a microfiber cloth 16, 27 with elastic edge can be used, which can be slipped over a side edge 58 of the application unit 22.

Figure 10A:
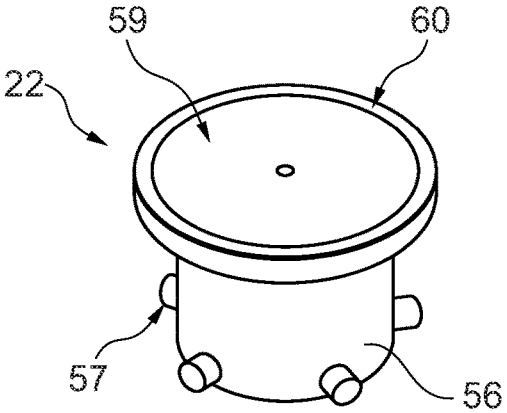
Figure 10B:
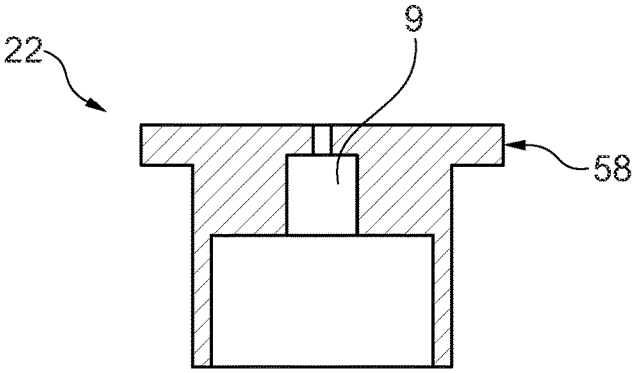

FIGS. 10A and 10B show a third variant of the application unit 22. A description of the same components with the same reference symbols as those in FIGS. 9A and 9B is not repeated here due to the brevity of the description. In contrast to the second variant of the application unit 22 as shown and described in FIGS. 9A and 9B, a hook-and-loop fastener 59 is provided on a face surface 60 of the third variant of the application unit 22. This hook-and-loop fastener 59 can be used to connect a microfiber cloth 16, 27 to the face surface 60 of the third variant of the application unit 22.

Figure 11A:
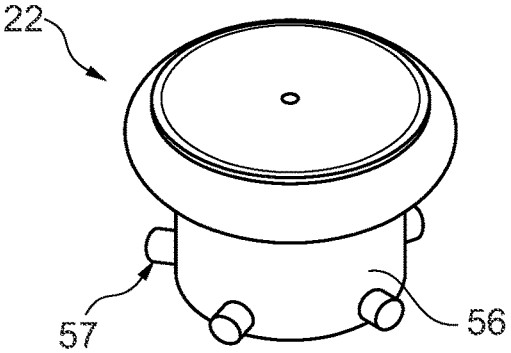
Figure 11B:
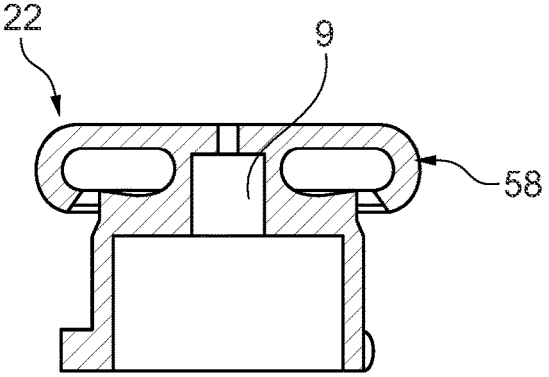

FIGS. 11A and 11B show a fourth variant of the application unit 22, which consists of the combination of the first variant of the application unit 22 with annular groove 29 and the plurality of cylindrical projections 57. This fourth variant of the application unit 22 can thus be connected to the first adapter 38 by means of a bayonet lock 44.

The bayonet lock 44, 52 is designed in such a way that the plurality of recesses 43, 51 allow the plurality of cylindrical projections 57 of the application unit 22 and/or the removal device 24 a relative movement in axial direction between the application unit 22 and/or the removal device 24 and the adapter 38, 39 or housing 1 of the device according to the invention. The special feature of the relative movability of the application unit 22 to the first adapter 38 is maintained for the pumping movement. On the opposite side at the removal device 24, this constructive variant of the bayonet lock 51 allows a relative movement between the removal device 24 and the second adapter 39 to provide a little play to prevent scratches. Optionally, the constructive configuration of the bayonet lock 44, 52 also serves to hold the application unit 22 or the removal device 24 in a special position in relation to the adapters 38, 39 and to hinder relative movement (not shown).

Figure 12A:
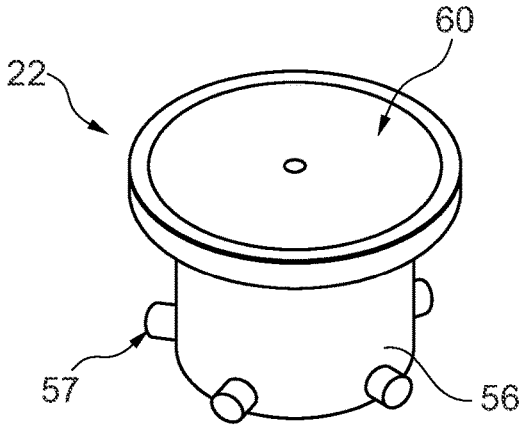
Figure 12B:
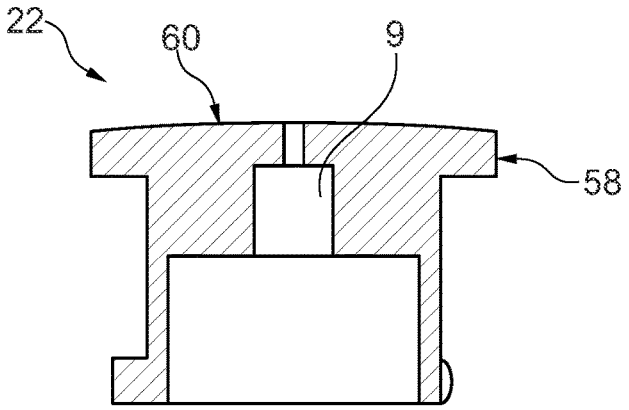

FIGS. 12A and 12B show a fifth variant of the application unit 22. A description of identical components with the same reference symbols as those in FIGS. 9A and 9B is not repeated here due to the brevity of the description. In contrast to the second version of the application unit 22 as shown and described in FIGS. 9A and 9B, the face surface 60 of the fifth variant of the application unit 22 is slightly curved (see FIG. 12B). In this fifth variant of the application unit 22, an agent of glue or other adhesive can be applied the microfiber cloth 16, 27 and/or to the curved face surface 60 to attach the microfiber cloth 16, 27 to the curved face surface 60. In a non-illustrated embodiment an adhesion configuration could be provided by positive interlocking of microscopically small pores and depressions between the materials involved.

Figure 13:
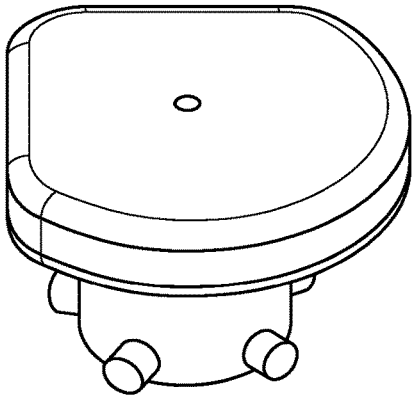

As shown in FIG. 13, all the described variants of the application unit 22 may also have a form other than a round form. In addition to the round form of the face surface 60, a drop-shaped form is preferred. The choice of a drop-shaped form for the application unit 22 does not affect the shape of the face surface of the removal device 24, the housing 1 and the cover caps 33 and 36.

All previously described variants of the application unit 22 can also be regarded as variants for the removal device 24, since the application unit 22 differs from the removal device 24 only by the passage channel 9.

The skilled person will recognize that it is possible to redesign the lower section 56 of the application unit 22 and/or the removal device 24 in such a way that the connection to the first adapter 38 or the second adapter 39 can be made by one of a bayonet lock, a detachable rivet connection, a clip connection and a thread or by slipping, plugging or clamping.

Figure 14:
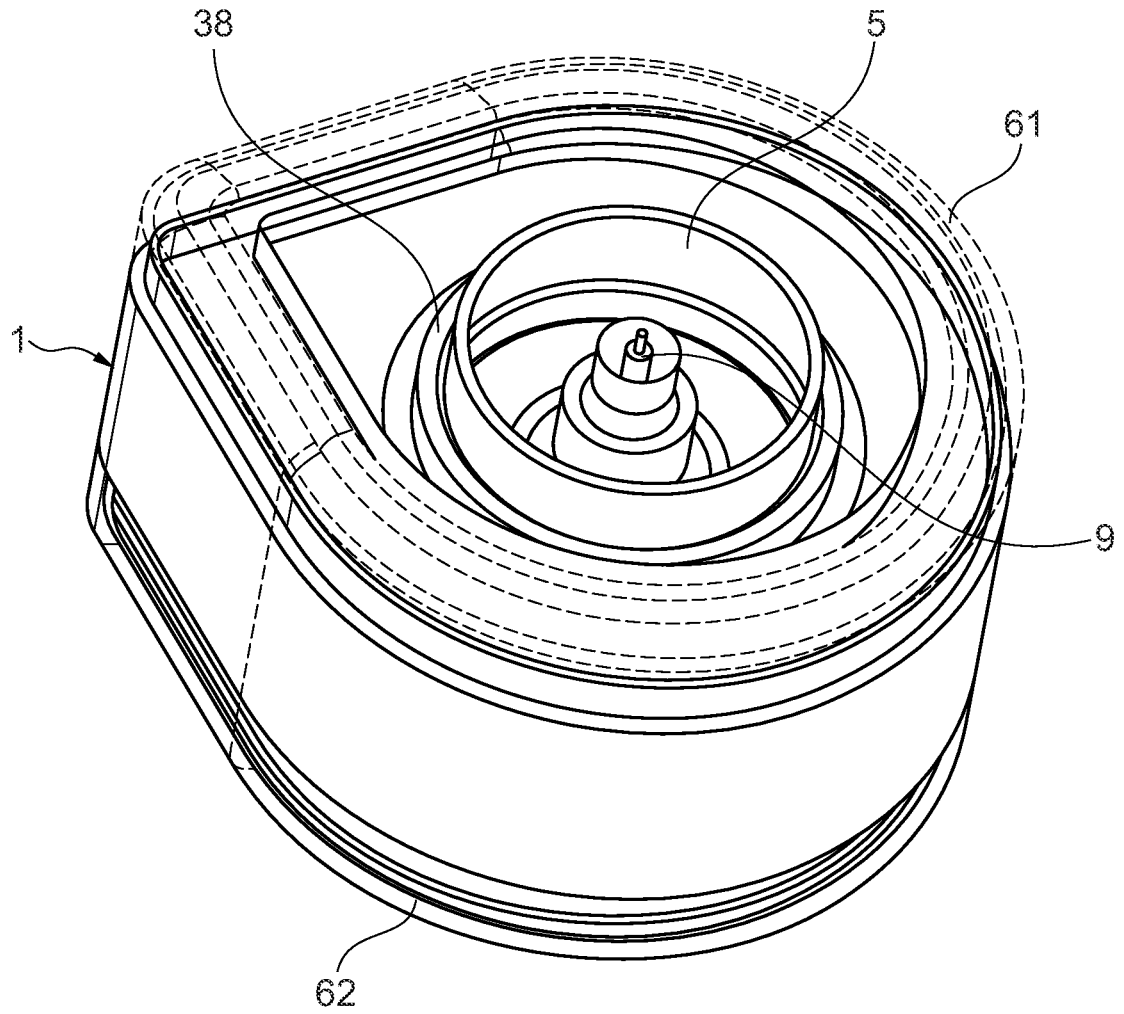

FIG. 14 shows a fourth variant of the previously described variants of the device in closed condition with a housing 1 and two partially transparent cover caps 61 and 62. The shape of the cover caps 61 and 62 and of the housing 1 is chosen as a drop-shaped form. It is to be noted here that also with the variants described above, instead of the round-shaped application unit 22 and removal device 24, at least one or both of them can be used in drop-shaped form. Under the partially transparent cover cap 61, the application unit 5, 22 can be seen according to the second variant. The application unit 5, 22 can be moved in axial direction relative to the first adapter 38 to allow a pumping movement. The pumping movement transports liquid of different viscosity from the reservoir via the outlet opening and the passage channel 9 to the top of the application unit 5, 22.

The skilled person will recognize that the device according to the invention is not limited to the foregoing. As particularly advantageous, the skilled person will recognize that the device according to the invention can be considered as a metering device, since no contamination can get into the container.

If a user wishes to wet a surface with a metered liquid of different viscosity for cleaning or moistening without coming into direct contact with the liquid, the upper cap 11, 23, 33, 61 of the device according to the invention is first removed from the housing 1 by the possibilities described. If necessary, the application unit 5, 22 can be provided with a new fresh microfiber cloth 16, 27. It is particularly advantageous here that the application unit, which is normally fixed by the bayonet lock, possibly with a degree of freedom of translation, can be detached from the device so that it can be replaced as a whole, or so that the microfiber cloth can be replaced more easily. Optionally, the application unit 5, 22 is then moved from the special position to the first adapter 38 in the bayonet lock 44 to allow relative movement between the application unit 5, 22 and the first adapter 38. The relative pumping movement between the application unit 5, 22 and the first adapter 38 reduces the gap 10 and exerts an impulse on the valve unit 21, which causes the liquid in the container 20 or in the reservoir 2 to be transported via the outlet opening 4 and the passage channel 9 to the top of the application unit 5, 22 and finally to the microfiber cloth 16, 27. By repeating the pumping movement, the amount of liquid on the microfiber cloth 16, 27 can be metered. By translatory movement of the entire device, the liquid on the microfiber cloth 16, 27 is transferred to the surface to be wetted (skin, display or similar).

After the surface has been wetted with metered liquid for cleaning or moistening, the application unit 5, 22 can optionally be moved back into the special position to the first adapter 38 in the bayonet lock 44 to prevent relative movement between the application unit 5, 22 and the first adapter 38 in the assembled state. After the upper cap 11, 23, 33, 61 has been attached back to the housing 1, the device according to the invention can be turned by 180 degrees. Now the lower cap 13, 26, 36, 62 of the device according to the invention is removed from housing 1 by the possibilities described. If necessary, the removal device 24 can be provided with anew fresh microfiber cloth 16, 27. It is particularly advantageous here that the removal device, which is normally fixed by the bayonet lock, possibly with a degree of freedom of translation, can be detached from the device so that it can be replaced as a whole, or so that the microfiber cloth can be replaced more easily. Optionally, the removal device 24 is then moved from the special position to the second adapter 39 in the bayonet lock 52 to allow relative movement or play between the removal device 24 and the second adapter 39. By translatory movement of the entire device, excessive liquid is removed from the wetted surface by the microfiber cloth 16, 27, thus wiping the surface dry. After the surface is dry, the removal device 24 can optionally be moved back into the special position to the second adapter 39 in the bayonet lock 52 to prevent relative movement between the removal device 24 and the second adapter 39 in the assembled state. Finally, the lower cap 13, 26, 36, 62 is attached to the housing 1 again.

LIST OF REFERENCE CHARACTERS

1 Housing
2 Reservoir
3 Valve unit
4 Outlet opening
5 Application unit
7 Application element
8 Connection part
9 Passage channel
10 Intermediate space
11 Closure cap
12 Removal device
13 Closure flap
14 Outer unit
15 Inner part
16 Microfiber cloth
17 Recess
18 Recess
20 Container
21 Valve unit
22 Application unit
23 Cover
24 Removal device
25 Element
26 Cover flap
27 Microfiber cloth
28 Channel
29 Annular groove
30 Barb
31 Barb
33 Cover cap
36 Cover cap
38 First adapter
39 Second adapter
40 Thread
41 Section
42 Passage channel
43 Recess
44 Bayonet lock
45 Upper section
46 Lower section
47 Collar
48 Cylindrical section
49 Inner side
50 Inner side
51 Recess
52 Bayonet lock
53 Upper section
54 Collar
55 Lower section
56 Lower section
57 Cylindrical projection
58 Side edge
59 Hook-and-loop fastener
60 Face surface
61 Cover cap
62 Cover cap

What is claimed is:

1. A device for applying a liquid of different viscosity to a surface to be wetted, comprising:

a housing having a reservoir for holding a liquid;

a valve unit for the metered discharge of the liquid from an outlet opening of the reservoir;

an application unit connected to the valve unit on its outer side facing away from the housing for applying the liquid to a surface to be wetted; and a removal device is arranged for removing excess liquid from the surface wetted by the application unit on the side of the housing opposite the application unit, wherein the removal device has a working surface provided with a removal means in the form of a microfiber cloth, the working surface being arranged on the outside of an outer part which is detachably connected to the housing, and wherein the removal device has an elastic element under the microfiber cloth for storing the liquid removed by the microfiber cloth.

2. The device according to claim 1, wherein the housing has an interior into which a can-shaped separate container filled with the liquid is inserted in a replaceable manner.

3. The device according to claim 1, wherein a coupling unit for separating and connecting the components is arranged between an outer part and the housing.

4. The device according to claim 3, wherein the coupling unit has one or more connection clips.

5. The device according to claim 1, wherein the removal device can be covered with a cover flap.

6. The device according to claim 1, wherein the microfiber cloth is held in position by barbs on the edge of an annular groove, the annular groove being arranged in the element or in the outer part.

7. The device according to claim 1, wherein the annular groove has an oval cross-section and is connected via a channel to the outside of the element or to the outer part.

8. The device according to 1, wherein the application unit and/or the removal device is/are each mounted on the housing via an adapter, advantageously detachably mounted on the housing.

9. The device according to claim 8, wherein the application unit and/or the removal device can be connected to the respective adapter by one of a bayonet lock, a thread, a detachable rivet connection, a clip connection and/or a threadless section which can be slipped on, plugged on or clipped on.

10. The device according to claim 8, wherein the adapter is connected to the housing by one of a form fit, a clip and a thread and/or can be slipped on, plugged on or clipped on over an upper region.

11. The device according to claim 9, wherein the bayonet lock is configured such that a plurality of recesses allows a plurality of cylindrical projections of the application unit and/or the removal device a relative movement in the axial direction between the application unit and/or the removal device to the respective adapter.

12. The device according to claim 1, wherein a microfiber cloth can be connected to the application unit and/or the removal device by one of a hook-and-loop fastener, an adhesion configuration, an adhesive, an overwrapping of an elastic edge of the microfiber cloth and barbs on an annular groove.

13. A device for applying a liquid of different viscosity to a surface to be wetted, comprising a container for the liquid arranged in a housing;

a valve unit for the metered discharge of the liquid from the container;

an application unit connected to the valve unit on its outer side facing away from the housing; and a removal device is arranged for removing excess liquid from the surface wetted by the application unit on the side of the housing opposite the application unit, wherein the removal device has a working surface provided with a removal means in the form of a microfiber cloth, the working surface being arranged on the outside of an outer part which is detachably connected to the housing, and wherein the removal device has an elastic element under the microfiber cloth for storing the liquid removed by the microfiber cloth.

* * * * *